US007614770B2

(12) United States Patent
Lanczy

(10) Patent No.: US 7,614,770 B2
(45) Date of Patent: Nov. 10, 2009

(54) LOCATOR TOOL FOR A LIGHT FIXTURE

(75) Inventor: Geza T. Lanczy, Auburn, IN (US)

(73) Assignee: Group Dekko, Inc., Kendallville, IN (US)

( * ) Notice: Subject to any disclaimer, the term of this patent is extended or adjusted under 35 U.S.C. 154(b) by 41 days.

(21) Appl. No.: 11/952,360

(22) Filed: Dec. 7, 2007

(65) Prior Publication Data

US 2009/0144998 A1 Jun. 11, 2009

(51) Int. Cl.
*F21V 15/01* (2006.01)

(52) U.S. Cl. ..... 362/375; 362/408; 362/374; 362/370

(58) Field of Classification Search ..... 362/408, 362/374, 375, 370
See application file for complete search history.

(56) References Cited

U.S. PATENT DOCUMENTS

| | | | | |
|---|---|---|---|---|
| 2,487,468 | A | 11/1949 | Naysmith | 240/51.11 |
| 2,765,397 | A | 10/1956 | Harris | 240/51.11 |
| 3,019,333 | A * | 1/1962 | Pascucci | 362/355 |
| 4,536,830 | A | 8/1985 | Wisniewski | 362/223 |
| 5,713,757 | A | 2/1998 | Karst et al. | 439/445 |
| 6,648,709 | B2 | 11/2003 | Teichgraeber et al. | 445/4 |
| 7,097,327 | B1 * | 8/2006 | Barton | 362/260 |
| 2002/0137381 | A1 | 9/2002 | Chapman et al. | 439/215 |
| 2007/0070619 | A1 * | 3/2007 | Galli et al. | 362/157 |
| 2007/0075202 | A1 * | 4/2007 | Gordon | 248/289.11 |
| 2007/0087604 | A1 | 4/2007 | Hayes et al. | 439/215 |

* cited by examiner

*Primary Examiner*—Laura Tso
(74) *Attorney, Agent, or Firm*—Taylor & Aust, P.C.

(57) ABSTRACT

A bracket locator for use with a fixture. The bracket locator including a main body, a swinging arm and a plurality of alignment protrusions. The swinging arm is rotatably connected to the main body. The plurality of alignment protrusions include a first protrusion and a second protrusion. The first protrusion extends from the main body. The second protrusion extends from the swinging arm.

18 Claims, 3 Drawing Sheets

LOCATOR TOOL FOR A LIGHT FIXTURE

BACKGROUND OF THE INVENTION

1. Field of the Invention

The present invention relates to a locator tool or jig for use with a light fixture, and, more particularly, to a locator tool for positioning an end cap bracket of a light fixture.

2. Description of the Related Art

Light fixtures, particularly those using elongated lamps have corresponding elongated reflectors/fixtures that are often made of bent or extruded metal or other somewhat flexible material. The reflector is often economically produced having brackets installed therein for providing rigidity and mounting features to hold electrical receptacles for the bulb.

Brackets are often installed at key positions particularly proximate to the end portions of the reflector and/or extrusion and are positioned and fastened with fasteners as the assembly is formed. Screws are often utilized to hold the brackets to the reflectors and the reflectors may have positioning features to assist an operator in the location of the bracket and for the starting of the screw. The assembly of the light fixture may be done prior to shipping of a finished product or may be completed by the light installer at the point of use. A difficulty in the assembling of the brackets occurs because of the potential for misalignment of the bracket or warping of the reflector. Improper positioning and fastening of the bracket to the reflector can result since the bracket has to be held and screwed in typically at least three locations.

What is needed in the art is an apparatus and method for positioning brackets relative to light fixtures for uniform installation of the brackets to the fixtures.

SUMMARY OF THE INVENTION

The present invention relates to a locator assembly for use with a lighting reflector to position a bracket at an end portion of the reflector.

The invention, in one form is directed to a bracket locator for use with a fixture, the bracket locator includes a main body, a swinging arm and a plurality of alignment protrusions. The swinging arm is rotatably connected to the main body. The plurality of alignment protrusions include a first protrusion and a second protrusion. The first protrusion extends from the main body. The second protrusion extends from the swinging arm.

An advantage of the present invention is that the bracket locator retains the bracket in a desired position until the bracket is fastened to the lighting fixture.

Another advantage of the present invention is that the bracket locator cam locks to the fixture for ease of installation and removal therefrom.

Yet another advantage of the present invention is that the protrusions grip the lighting fixture when the swinging arm is in the cam locked position.

Still yet another advantage of the present invention is that the bracket locator installed on the fixture and the bracket is located relative to the bracket locator without the use of any other tools.

A further advantage of the present invention is that the camming action of the bracket locator functions to move or flex the lighting fixture, perhaps even slightly, to provide a uniform shape to which the bracket is then appropriately attached.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
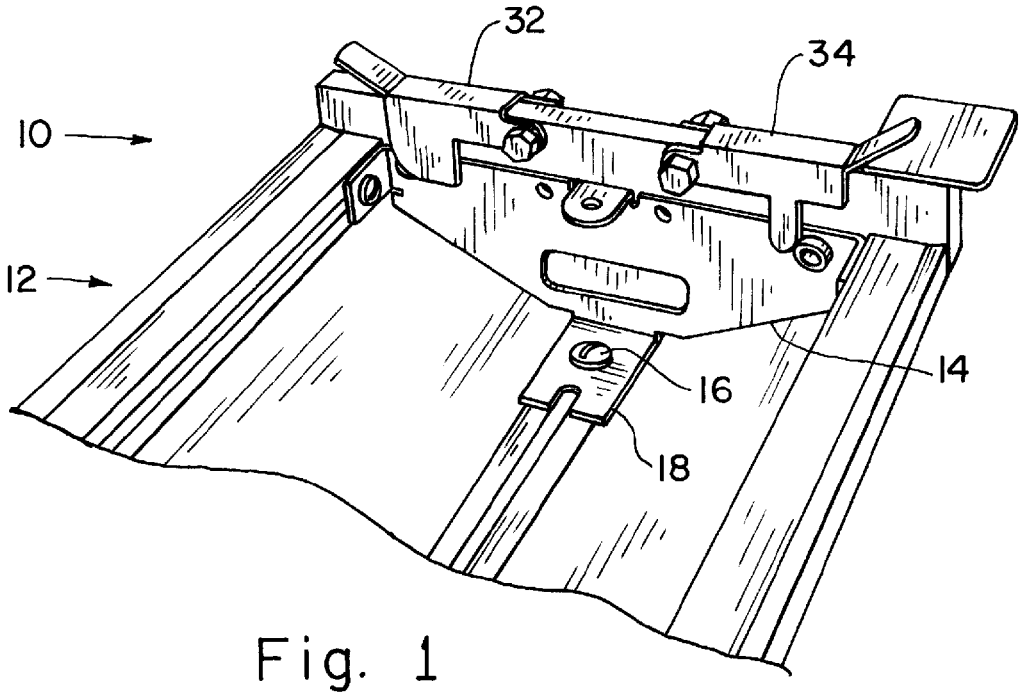
FIG. 1 is a perspective view including one embodiment of a bracket locator of the present invention.

Referring now to the drawings, and more particularly to FIGS. 1-5, there is illustrated a bracket locator 10 that is connectable to a linear light extrusion or member 12 having a bracket 14 that is attached to linear light member 12 in a temporary fashion so that bracket 14 can be positioned against bracket locator 10 and installed to linear light member 12 by way of screws 16 or other suitable fasteners. Bracket 14 includes tabs with holes 18 connected to structural member 20. Typically one bracket 14 is positioned at each end of linear light member 12 being fastened thereto by screws 16. For the sake of simplicity only one end of linear light member 12 is illustrated and discussed herein although it is understood that typically two brackets 14 are associated with each linear light member 12. The interaction of bracket locator 10 with light member 12 and bracket 14 may be thought of as an assembly 50, although bracket locator 10 is connected only temporarily with light member 12 and bracket 14 so as to facilitate the fastening of bracket 14 to light member 12. After the fastening of light bracket 14 to light member 12, bracket locator 10 is disengaged from the resulting assembly.

Linear light member 12 can serve as a reflector or other structural part of a lighting fixture and may be an extrusion or bent, metal or a formed composite or plastic material to which a bracket 14 is to be attached.

Bracket locator 10 includes a main body 22, a swinging arm 24, protrusions 26 and 28 respectively positioned on main body 22 and swinging arm 24.

Main body 22 may have a portion that is proximate to swinging arm 24 that is multi-layered so that swinging arm 24 may consist of more than one piece of material spaced apart by a portion of main body 22 to provide strength to swinging arm 24. At one end of swinging arm 24 associated with main body 22 is pivot point axis 30 about which swinging arm 24 is rotatably connected to main body 22. Protrusions 26 and 28 may be cylindrical rods that are each connected at one end to main body 22 and swinging arm 24 respectively. Protrusions 26 and 28 may be similar in length and may include gripping features such as threads, knurls or annular rings so that they can interact with linear light member 12 in a gripping fashion when associated with an end of linear light member 12. Protrusion 28 is associated with an end of swinging arm 24 that is opposite the end associated with pivot point axis 30.

Figure 2:
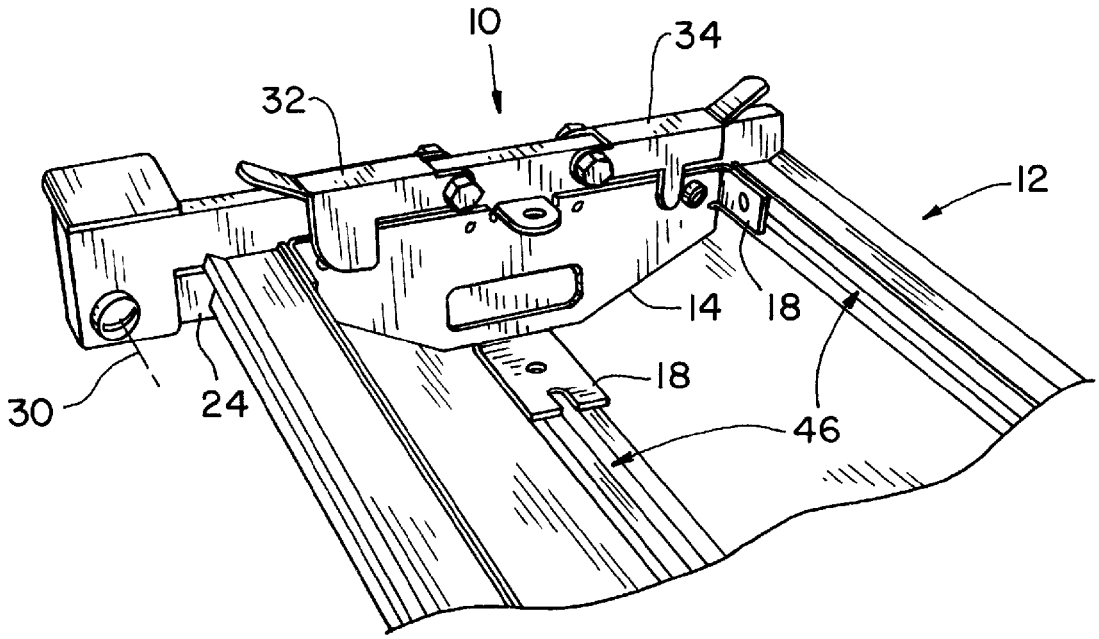
FIG. 2 is a perspective view of another embodiment of the bracket locator of the present invention.

FIG. 2 illustrates an embodiment of bracket locator 10 that has swinging arm 24 pivoting about an extension of main body 22 and on an opposite end as that illustrated in FIG. 1. In this embodiment the structure is substantially similar and the action is the same as the embodiment illustrated in FIGS. 1 and 3-5, except for the location of pivot point axis 30. The location of pivot point axis 30 allows for an over-center locking of bracket locator 10 relative to fixture 12 in the same manner as that discussed for the embodiment of FIGS. 1 and 3-5. For purposes of clarity the remaining discussion pertains to the embodiment illustrated in FIGS. 1 and 3-5, but the principles apply equally to the embodiment illustrated in FIG. 2.

Retaining tabs 32 and 34 are attached to main body 22 and are positioned and shaped so that they may temporarily interact with bracket 14 and hold bracket 14 next to main body 22 during the installation process of attaching bracket 14 to linear light member 12. Retaining tabs 32 and 34 each include a tab portion that interacts with bracket 14 and additionally includes a tab that allows the user to easily swing retaining tabs 32 and 34 into position to hold bracket 14 in place. Portions of retaining tabs 32 and 34 may be shaped to draw bracket 14 tightly against main body 22. Retaining tab 32 rotates about an axis 36 and retaining tab 34 rotates about an axis 38. Axis 36 and axis 38 are substantially parallel with each other and are substantially parallel with a longitudinal axis of linear light member 12.

Protrusion 26 is generally longitudinally oriented around axis 40 as is protrusion 28 oriented about axis 42. Axes 26, 36, 38, 40 and 42 are all generally parallel to each other in the embodiment shown and described herein. However, other alignments are also contemplated, which may correspond to the shape of bracket 14 as well as connecting features that may be associated with linear light member 12. Linear light member 12 includes channels 46 may be utilized for the connection of bracket 14 by way of screws 16 on an interior portion of linear light member 12. Linear light member 12 additionally includes features that are complimentary to protrusions 26 and 28 for the connection on a temporary basis of protrusions 26 and 28 to features 48.

Swinging arm 24 works in a camming type manner as bracket locator 10 is connected to linear light member 12. Typically during installation swinging arm 24 is located below line 44 as protrusions 26 and 28 are inserted into features 48 of linear light member 12. The exact positioning of swinging arm 24 is left up to the operator to thereby allow an ease of insertion of protrusions 26 and 28 into features 48. Once protrusions 26 and 28 are fully inserted into features 48 the operator presses down on main body 22 so that protrusion 28 is then positioned above line 44 as swinging arm 24 is swung upwardly thereby locking bracket locator 10 to fixture 12. This interaction of swinging arm 24 with main body 22 positions swinging arm 24 in an over-center position thereby locking bracket locator 10 to linear light member 12. Protrusion 28 in this position is proximate to main body 22 and may rest thereagainst to hold swinging arm 24 in a cam locked position. This advantageously may flex linear light member 12 so as to have a more exacting form in its cross sectional shape and allow for uniform installation of a bracket 14 thereto. Bracket 14 is positioned against main body 22 and retaining tabs 32 and 34 are swing into position to hold bracket 14 in position so that screws 16 can be installed through tabs 18 into channels 46.

To remove bracket locator 10, once bracket 14 is connected to linear light member 12, retaining tabs 32 and 34 are swung away from bracket 14 to thereby disengage bracket 14. Main body 22 is then lifted thereby brining swinging arm 24 out of a cam locked position and bracket locator 10 is moved in a longitudinal manner away from linear light member 12 so that protrusions 26 and 28 disengage from features 48.

Protrusion 28 of swinging arm 24 swings in an arc about pivot point axis 30 and for most of the arc, through which protrusion 28 is positioned is on a non-cam locking side of line 44. The positioning of protrusion 28 on swinging arm 24 is such that axis 42 crosses line 44 thereby providing the camming type operation of bracket locator 10 relative to linear light member 12.

Figure 3:
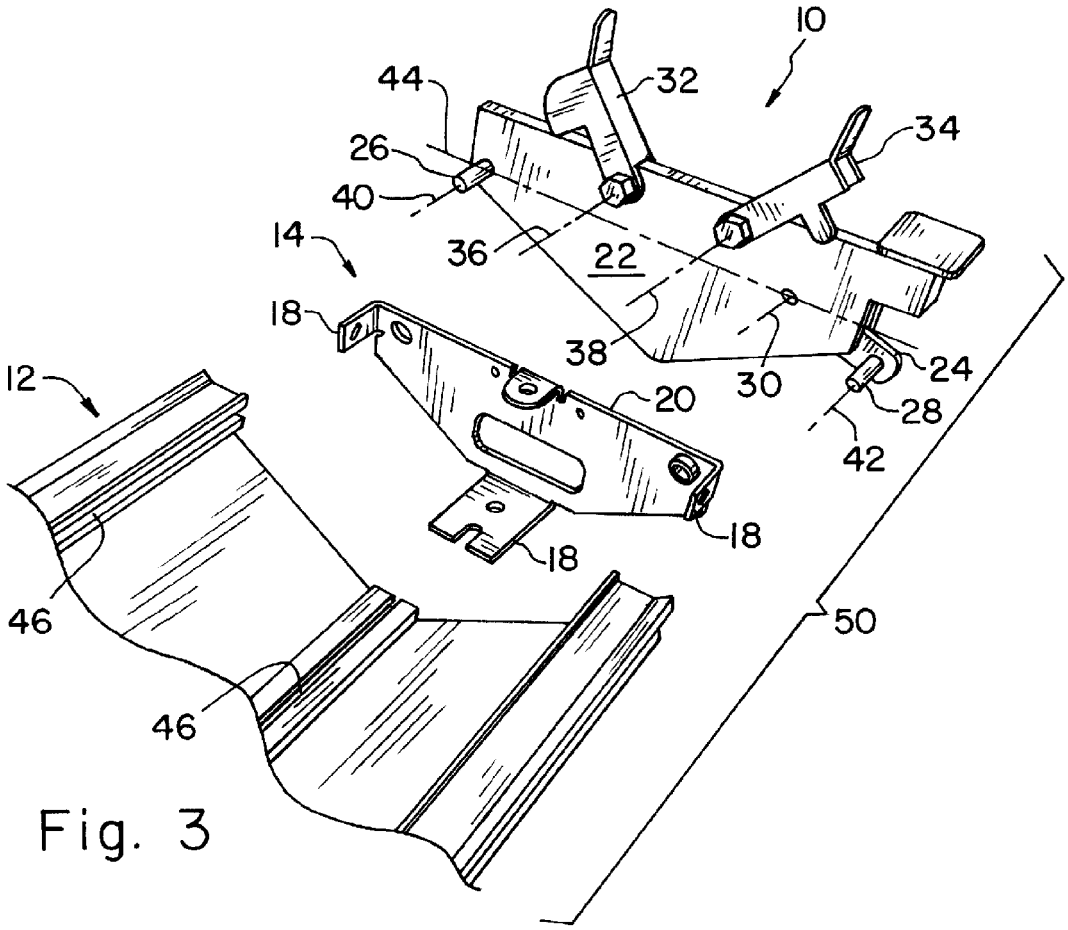
FIG. 3 is an exploded perspective view of the bracket locator of FIG. 1.
Figure 4:
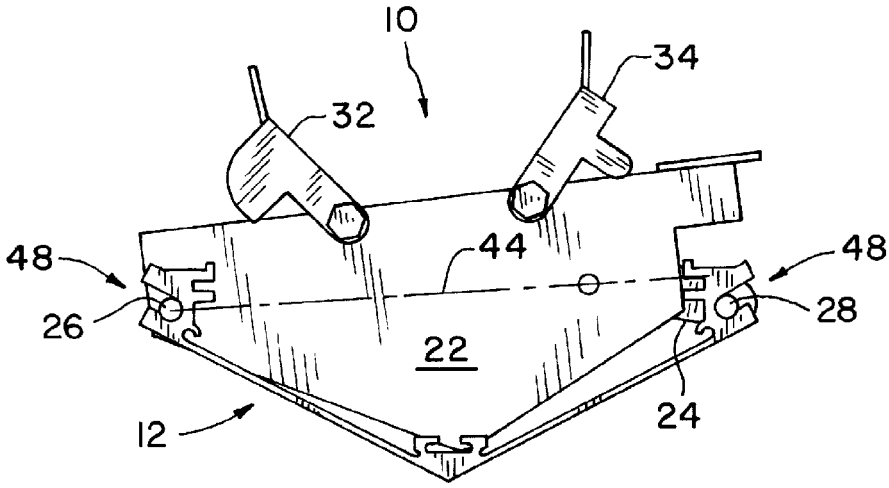
FIG. 4 is a plan view of the bracket locator of FIGS. 1 and 3 being connected to a linear light extrusion.
Figure 5:
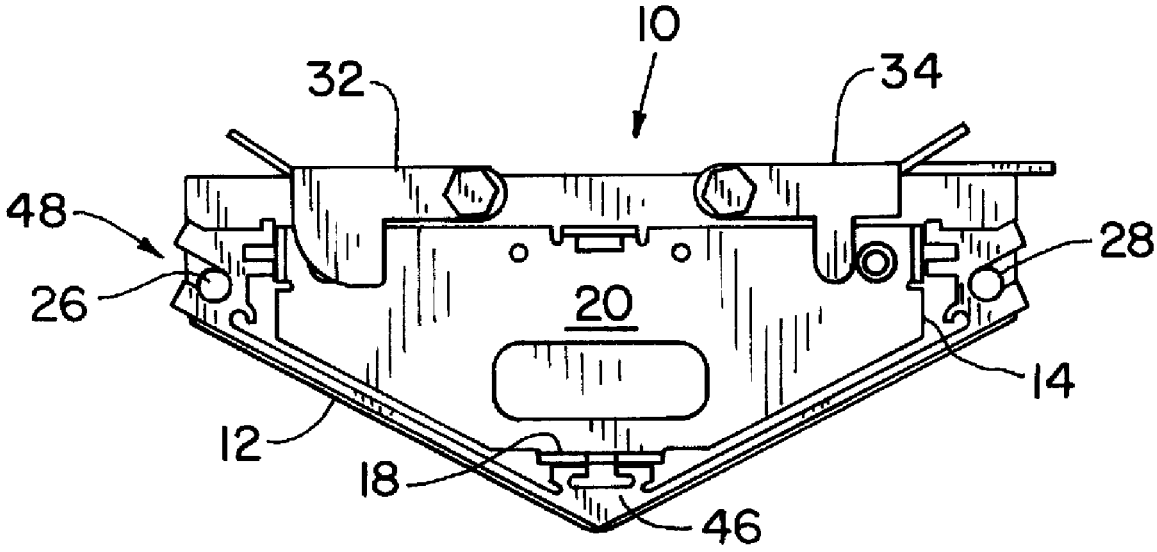
FIG. 5 is an end view of the extrusion having the bracket locator of FIGS. 1-4 positioning a bracket for installation of the bracket to the extrusion.

The present invention advantageously provides an accurate cross-sectional shape to linear light member 12 and holds bracket 14 in position for connection to linear light member 12 for attachment to each end of linear light member 12. FIGS. 2 and 3 illustrate two embodiments of how swinging arm 24 may be configured either pivoting from an inner portion of main body 22 or by way of an extension of main body 22 to thereby illustrate two different embodiments of Applicant's invention.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A bracket locator for use with a fixture, the bracket locator comprising:

a main body;

a swinging arm rotatably connected to said main body;

a plurality of alignment protrusions including a first protrusion and a second protrusion, said first protrusion extending from said main body, said second protrusion extending from said swinging arm; and at least one pivoting retainer being pivotally attached to said main body, said at least one pivoting retainer being configured to hold the bracket against said main body.

2. The bracket locator of claim 1, wherein said plurality of alignment protrusions are substantially parallel.

3. The bracket locator of claim 2, wherein said swinging arm has a first end and a second end, said swinging arm having a pivot point proximate said first end about which said swinging arm is rotatable, said second protrusion proximate to said second end.

4. A bracket locator for use with a fixture, the bracket locator comprising:

a main body;

a swinging arm rotatably connected to said main body; and a plurality of alignment protrusions including a first protrusion and a second protrusion, said first protrusion extending from said main body, said second protrusion extending from said swinging arm, said plurality of alignment protrusions are substantially parallel, said swinging arm has a first end and a second end, said swinging arm having a pivot point proximate said first end about which said swinging arm is rotatable, said second protrusion proximate to said second end, said swinging arm comes into contact with said main body proximate said second protrusion when said swinging arm is swung in a direction, said second protrusion having an axis that is positioned on a first side of a line extending through said pivot point and said first protrusion when said swing arm is moved as far as possible in said direction.

5. The bracket locator of claim 4, wherein said swinging arm traverses an arc about said pivot point, said axis being on a second side of said line through most of said arc.

6. The bracket locator of claim 1, wherein said swinging arm rotates about an axis said at least one pivoting retainer pivoting about an other axis, said axis and said other axis being substantially parallel.

7. A bracket locator system for use with a fixture, the system comprising:

a main body;

a swinging arm rotatably connected to said main body;

a plurality of alignment protrusions including a first protrusion and a second protrusion, said first protrusion extending from said main body, said second protrusion extending from said swinging arm, said alignment protrusions being inserted into a portion of the fixture; and at least one pivoting retainer being pivotally attached to said main body, said at least one pivoting retainer being configured to hold the bracket against said main body.

8. The bracket locator system of claim 7, wherein said plurality of alignment protrusions are substantially parallel.

9. The bracket locator system of claim 8, wherein said swinging arm has a first end and a second end, said swinging arm having a pivot point proximate said first end about which said swinging arm is rotatable, said second protrusion proximate to said second end.

10. A bracket locator system for use with a fixture, the system comprising:

a main body;

a swinging arm rotatably connected to said main body; and a plurality of alignment protrusions including a first protrusion and a second protrusion, said first protrusion extending from said main body, said second protrusion extending from said swinging arm, said alignment protrusions being inserted into a portion of the fixture, said plurality of alignment protrusions being substantially parallel, said swinging arm has a first end and a second end, said swinging arm having a pivot point proximate said first end about which said swinging arm is rotatable, said second protrusion proximate to said second end, said swinging arm comes into contact with said main body proximate said second protrusion when said swinging arm is swung in a direction, said second protrusion having an axis that is positioned on a first side of a line extending through said pivot point and said first protrusion when said swing arm is moved as far as possible in said direction.

11. The bracket locator system of claim 10, wherein said swinging arm traverses an arc about said pivot point, said axis being on a second side of said line through most of said arc.

12. The bracket locator system of claim 7, wherein said swinging arm rotates about an axis said at least one pivoting retainer pivoting about an other axis, said axis and said other axis being substantially parallel.

13. A method of locating a bracket relative to a fixture using a bracket locator, the method comprising the steps of:

interacting a plurality of features of the bracket locator with reciprocal features in the fixture;

rotating a swinging arm of the bracket locator into a cammed position thereby positioning the bracket locator relative to the fixture, said swinging arm having at least one of said plurality of features positioned proximate to an end of said swinging arm; and positioning the bracket proximate to the bracket locator.

14. The method of claim 13, wherein said plurality of features include a first alignment protrusion and a second alignment protrusion that are substantially parallel, said first alignment protrusion extending from a main body of the bracket locator.

15. The method of claim 14, wherein said swinging arm has a first end and a second end, said swinging arm having a pivot point proximate said first end associated with said main body, said swinging arm rotatable about said pivot point, said second protrusion proximate to said second end.

16. The method of claim 15, wherein said swinging arm comes into contact with said main body proximate said second protrusion when said swinging arm is swung in a direction, said second protrusion having an axis that is positioned on a first side of a line extending through said pivot point and said first protrusion when said swing arm is moved as far as possible in said direction.

17. The method of claim 16, wherein said swinging arm traverses an arc about said pivot point, said axis being on a second side of said line through most of said arc.

18. The method of claim 13, further comprising the step of pivoting at least one pivoting retainer to hold the bracket against said main body, said at least one pivoting retainer being pivotally attached to said main body, said swinging arm rotates about an axis said at least one pivoting retainer pivoting about an other axis, said axis and said other axis being substantially parallel.

* * * * *